United States Patent [19]

Berning

[11] Patent Number: 4,941,496

[45] Date of Patent: Jul. 17, 1990

[54] WALKER WITH PIVOTING WHEEL

[76] Inventor: Louis G. Berning, 285 Canyon Mesa Dr., Sedona, Ariz. 86336

[21] Appl. No.: 327,694

[22] Filed: Mar. 23, 1989

[51] Int. Cl.[5] ..... A61H 3/00

[52] U.S. Cl. ..... 135/67; 135/72; 135/84; 272/70.3

[58] Field of Search ..... 135/67, 72, 75, 84; 272/70.3, 70.4

[56] References Cited

U.S. PATENT DOCUMENTS

| | | | |
|---|---|---|---|
| 2,238,445 | 4/1941 | Kilstrom . | |
| 2,757,388 | 8/1956 | Chisholm | 135/65 X |
| 2,792,052 | 5/1957 | Johannesen . | |
| 2,792,874 | 5/1957 | Sundberg . | |
| 3,350,095 | 10/1967 | Clasen . | |
| 3,442,276 | 5/1969 | Edwards et al. | 135/67 |
| 3,455,313 | 7/1969 | King | 135/67 |
| 3,553,746 | 1/1971 | Seiger . | |
| 3,591,874 | 7/1971 | O'Kennedy . | |
| 3,668,723 | 5/1972 | Bratton . | |
| 3,739,793 | 6/1973 | Wilson . | |
| 3,993,349 | 11/1976 | Neufeld et al. . | |
| 4,046,374 | 9/1977 | Breyley . | |
| 4,251,105 | 2/1981 | Baker . | |
| 4,411,283 | 10/1983 | Lucarelli | 135/67 |
| 4,474,202 | 10/1984 | Blechner . | |
| 4,510,956 | 4/1985 | King . | |
| 4,700,730 | 10/1987 | Samuelson et al. . | |
| 4,742,838 | 5/1988 | Muiza et al. | 135/67 |

FOREIGN PATENT DOCUMENTS

| | | | |
|---|---|---|---|
| 2036570 | 7/1980 | United Kingdom | 272/70.3 |

*Primary Examiner*—David A. Scherbel
*Assistant Examiner*—Lan Mai
*Attorney, Agent, or Firm*—Kolisch, Hartwell & Dickinson

[57] ABSTRACT

A walker includes a frame which has pair of spaced apart upright members. A cross piece extends between the upright members adjacent the lower end thereof. A handle portion is attached to the upright members at the upper end thereof. The handle portion includes a pair of opposed, vertically disposed segments which are receivable on the upright members. A grip pair is located on top of each vertically disposed segment and includes two grips, located one above the other, which are in vertical alignment with each other. A transverse element extends between the grip pairs. A foot is located on the lower end of each upright member and is perpendicular thereto. Each foot includes a pad which is fixed to the upright member and a wheel which is pivotably hinged to the pad and is flexibly biased to extend linearly from and end of the pad.

13 Claims, 2 Drawing Sheets

WALKER WITH PIVOTING WHEEL

BACKGROUND AND SUMMARY OF THE INVENTION

The invention relates to orthopedic walkers, and specifically to a walker which provides assistance to a person when changing from a sitting to standing position, or vice-versa, or when ascending or descending stairs.

A conventional orthopedic walker is usually constructed so that it surrounds the user on three sides of the user's body. This allows the placement of a support point for the walker at the four corners thereof, which are provides support points for the user which are distributed on all sides of the user. Such placement of the support points on a walker provide maximum stability for a user and may enable the user to catch himselve should he start to fall in any direction.

A number of variations have been made to the conventional walker, including the addition of wheels, brakes, sitting platforms, and the provision of hydraulic lifting mechanisms so that the walker may be used to lift an invalid in and out of bed, or in and out of a bathtub.

Although a number of walker designs are known which may be moved up to a chair or to the side of a bed to provide assistance in rising, the known structures are limited in their utility in that the base of the structure and the uprights connected to the base frequency interfere with the user's legs and/or the legs of the chair or bed. None of the known structures are particularly suitable for use in ascending or descending stairs.

An object of the instant invention is to provide a walker which provides support and increased stability for the user thereof.

Another object of the invention is to provide a walker which provides assistance for an individual in rising from or sitting in a chair.

Still another object of the invention is to provide a walker which is operable to provide assistance to the user in ascending and descending stairs.

Another object of the invention is to provide a walker which is of relatively simple construction, is light weight, and is inexpensive to manufacture.

The walker of the invention includes a frame which has a pair of spaced apart upright members. A cross piece extends between the upright members adjacent the lower end thereof. A handle portion is attached to the upright members at the upper end thereof. The handle portion includes a pair of opposed, vertically disposed segments which are received on the upright members. A grip pair is located on top of each vertically disposed segment and includes two grips, located one above the other, which are in vertical alignment with each other. A transverse element extends between the grip pairs. A foot is located on the lower end of each upright member and is perpendicular thereto. Each foot includes a pad which is fixed to the upright member and a wheel which is hinged to the pad and is flexibly biased to extend linearly from and end of the pad.

These and other objects and advantages of the invention will become more fully apparent as the description which follows is read in conjunction with the drawings.

DETAILED DESCRIPTION OF THE PREFERRED EMBODIMENT

Figure 2:
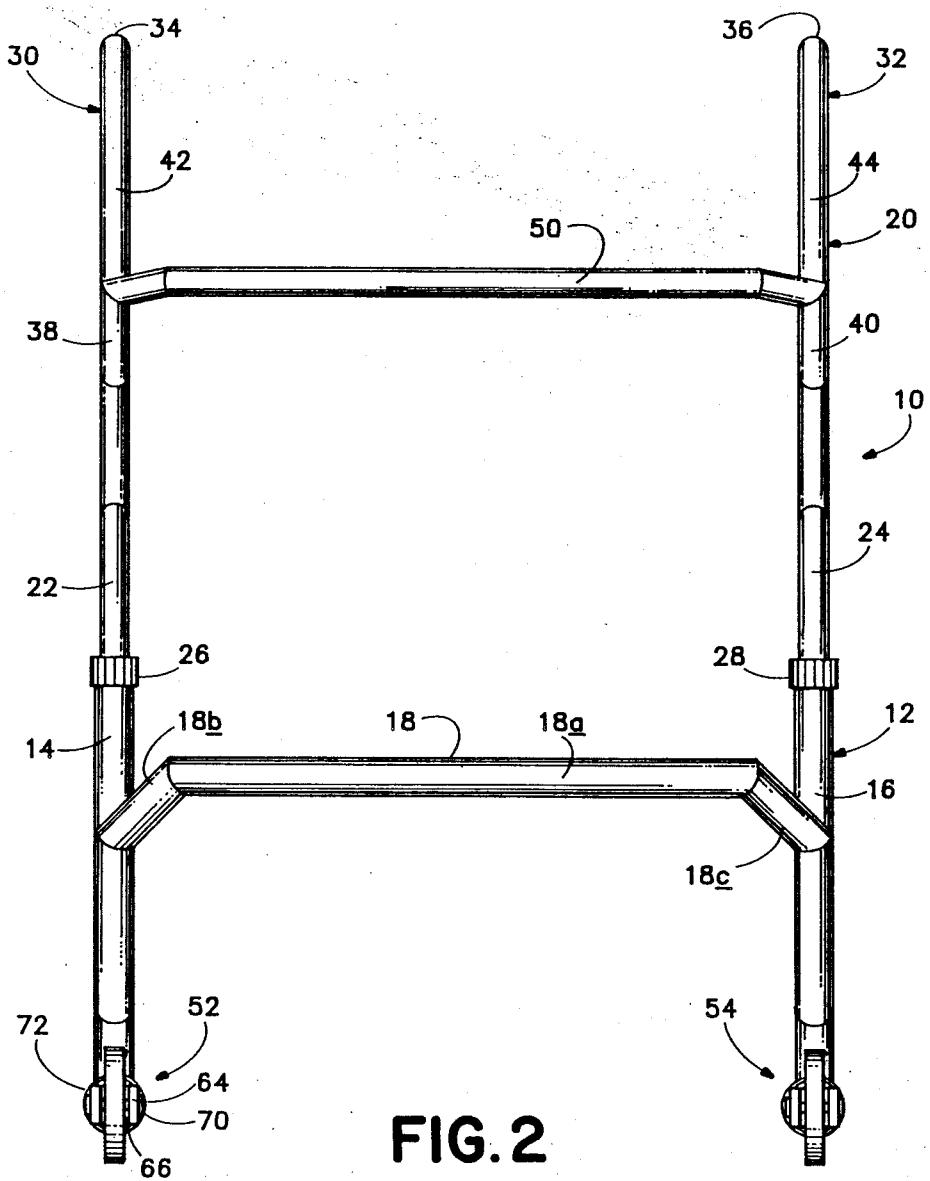
FIG. 2 is a front elevation of the walker, taken generally along the line 2—2 of FIG. 1.
Figure 1:
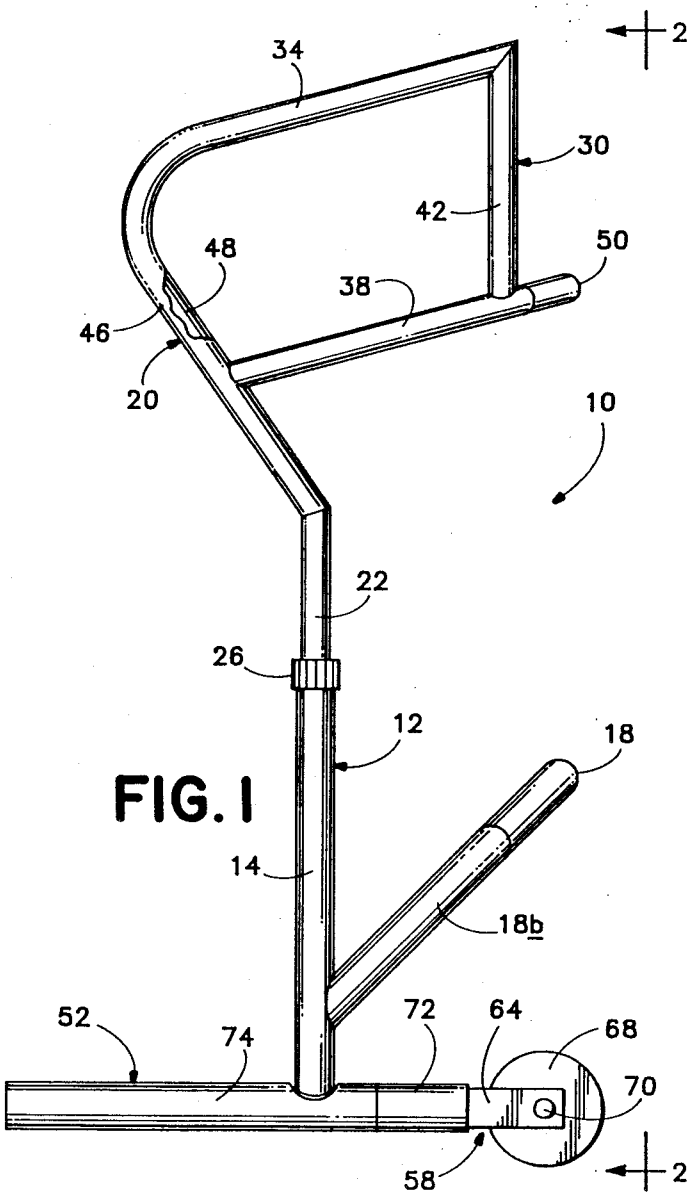
FIG. 1 is a right side elevation of a walker constructed according to the invention.

Referring now to the drawings, and initially to FIGS. 1 and 2, a walker constructed according to the invention is shown generally at 10. Walker 10 includes a frame 12 which includes upright members 14, 16 on either side thereof. Members 14 and 16 are spaced apart and have a cross piece 18 extending therebetween. Cross piece 18 is attached to members 14, 16 adjacent the lower ends thereof. The cross piece has a somewhat U-shaped form and includes a transverse element **18*a* and connecting elements 18*b*, 18*c*** between the transverse element and the upright members.

Walker 10 includes a handle portion 20. Handle portion 20 includes vertically disposed segments 22, 24 which are sized to be received in upright members 14, 16, respectively. The vertically disposed segments are telescopically received in the upright members and provide adjustment for the height of the handle portion. A variety of structures may be used to lock the height of handle portion 20 relative to frame 12. In the preferred embodiment, twist locks 26, 28 are provided to secure the relative height of handle portion 20 to frame 12.

Handle portion 20 includes a right grip pair 30 and a left grip pair 32. Grips pairs 30, 32 each include an upper grip 34, 36 and a lower grip 38, 40, respectively. Grip pairs 30, 32 are spaced from one another by a forward vertical support 42, 44 and a rear support 46, 48, respectively.

In the preferred embodiment, the upper and lower grip of each pair are vertically aligned with one another. A transverse element 50 extends between the grip pairs. Lower grips 38, 40 and transverse element 50 form a substantially U-shaped cage which defines the forward edge of the handle portion. In the preferred embodiment, the upper and lower grips are fixed relative to one another and are spaced six inches apart, although the design could be modified to enable adjustment of the distance between the upper and lower grips, or to provide additional, multilevel grips. In the preferred embodiment, vertically disposed segments 22,24 are adjustable in upright members 14,16, respectively, to provide adjustment of the upper grips between 30 inches and 40 inches above the level of the surface on which walker 10 is placed.

Figure 3:
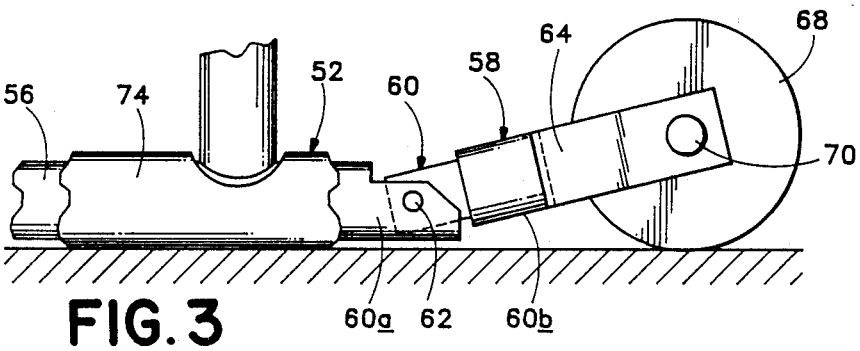
FIG. 3 is an enlarged side plan view of a foot pad and wheel of the invention.

Referring now to FIGS. 1–3, a foot, or foot portion of the walker is shown generally at 52, 54. The foot portions are essentially mirror images of one another and will be described in relationship to foot 52. Foot 52 is located on the lower end of upright member 14 and is constructed and arranged to be perpendicular to the upright member. The foot includes a pad 56 which is fixed to the upright member. A wheel mount 58 is connected to pad 56 by means of a hinge 60. Hinge 60 includes a first hinge portion **60*a* which, in the preferred embodiment, is integrally formed with pad 56. A second hinge portion 60*b* is attached to wheel mount 58. Hinge portions 60*a* and 60*b* are joined together by means of a hinge pin 62**.

Wheel mount 58 includes a wheel holder 64 which has a slot 66 formed therein for receiving a wheel 68. Wheel 68 is mounted to wheel holder 64 by means of an axle 70. Wheel 68 is flexibly biased to extend linearly from the end of pad 56 by biasing means 72. In the preferred embodiment, biasing means takes the form of a resilient tubular material, such as is commonly used for fluid-carrying hoses, which extends over a portion of pad 56 and wheel mount 58, surrounding hinge 60. An additional length of biasing material is used about pad 56 to provide a non-slip surface thereon. Wheel 68 is maintained in an axially aligned condition with pad 56 under normal circumstances. When the user bears down on walker 10, wheel 68 is deflected relatively upward, pivoting about pin 62, allowing the entire length of pad 56, surrounded by non-slip material 74, to rest on the surface, thereby disabling the rotary motion of wheel 68 and providing a firm footing for the walker. In the preferred embodiment, feet 52, 54 have an overall length of 15 inches.

Walker 10 may be formed of tubular aluminum stock which is joined together into the various components of the walker. Upright members, for instance, may be formed from one inch o.d. stock while vertically disposed segments 22, 24 may be formed from ⅞ inch o.d. stock, which will fit inside the one inch stock in a telescopic arrangement.

Figure 4:
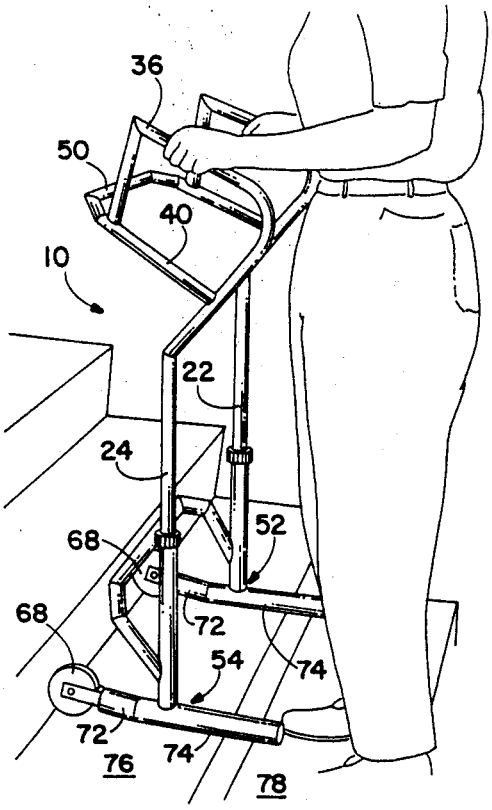
FIG. 4 is an environmental view depicting use of the walker on stairs.

As was previously noted, the walker of the invention is particularly well suited for assisting a user up and down stairs. Referring now to FIG. 4, the walker is depicted in a condition where it has been moved to a next higher stair 76 and the user is preparing to step from stair 78 to stair 76. To accomplish this, and depending on the height of the user and the adjustment of the handle portion relative to the frame, the user's hands may be placed on the upper or lower grips and the walker used to assist in climbing to the next higher stair. In this condition, with the user's weight applied to the walker, wheels 68 will be pivoted about pin 62 and will be in a flexed, inoperative condition. It may be seen that the user's weight is borne ultimately on pads 56 which are supported by the stair.

In the event that the user is attempting to go down stairs, the walker may be grasped by the upper grips and moved to a lower stair, providing support for the user in descending to that next stair. Again, depending on the height of the user and the handle portion, it may be necessary for the user to shift hands between the upper and lower grips.

Figure 5:
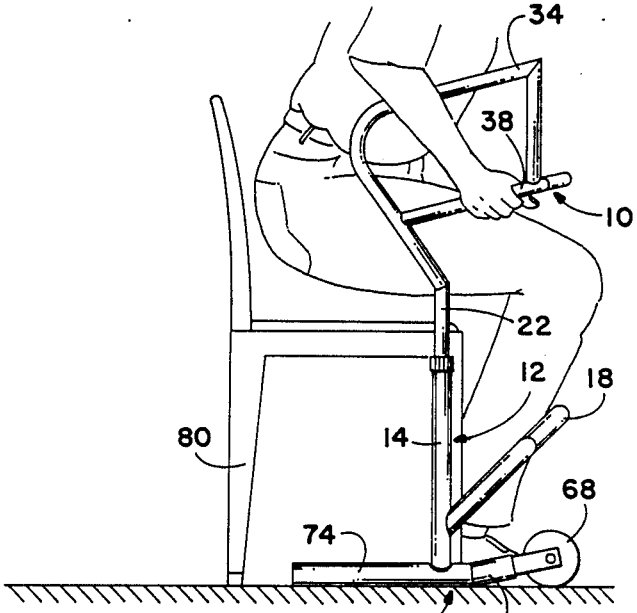
FIG. 5 is an environmental view of the walker as same is used for assisting the user in rising out of a chair.

Referring now to FIG. 5, walker 10 is depicted in assisting a user to sit on a chair 80. To accomplish this goal, the user stands in front of the chair and positions the walker so that feet 52, 54 are either under or along side the legs of the chair. The user may bend slightly forward, grasping lower grips 38, 40 and gently lower his or her body to the chair. To rise out of the chair, the walker is again positioned as close to the chair as desired, the user grasps the lower grips and uses them as a support to rise. The upper grips may then be grasped during the course of rising or before the user begins to walk.

In some instances, it may be desirable to provide cross piece 18 and transverse element 50 with an adjustable mechanism to allow adjustment of the width of the walker. It may also be desirable to provide a hinge mechanism to allow the walker to be collapsed into a substantially flat configuration for easy transportation.

Although a preferred embodiment of the invention has been described herein, it should be appreciated that variations and modifications may be made thereto without departing from the scope of the claims.

What I claim is:

1. A walker comprising:

a frame having a pair of spaced apart upright members, and a crosspiece extending between the upright members adjacent the lower end thereof;

a handle portion attached to the upright members adjacent the upper end thereof, said handle portion including a grip pair located above each upright member, each of said pairs including two grips located one above the other, and a transverse element extending between said grip pairs; and a foot located on the lower end of each upright member and arranged to be perpendicular to the upright member, each foot including a surface-contacting pad which is fixed to said upright member and is constructed and arranged to support the walker on a surface, said pad having a first hinge portion integrally formed therewith and extending forward thereof, said foot further including a second hinge portion flexibly secured to said first hinge portion by a horizontally extending hinge pin and a wheel carried in a wheel mount fixed to said second hinge portion wherein said wheel is hinged to said pad and is flexibly biased to extend linearly from an end of said pad to pivot in a vertical plane about said hinge pin.

2. The walker of claim 1 which further includes biasing means for biasing said wheel to a linearly extending position, said biasing means including a piece of tubular resilient material which extends about said foot pad and said wheel mount.

3. The walker of claim 1 wherein said grips in said grip pairs are vertically aligned with one another.

4. The walker of claim 1 wherein said upright members include means for adjusting the length of said upright member.

5. The walker of claim 1 wherein said foot pad has a non-slip surface thereon.

6. A walker comprising:

a frame having a pair of spaced apart upright members, and a crosspiece extending between the upright members adjacent the lower end thereof;

a handle portion attached to the upright members adjacent the upper end thereof, said handle portion including a pair of opposed, vertically disposed segments, each receivable on an upright member, a grip pair on top of each vertically disposed segment, each of said pairs including two grips located one above the other which are vertically aligned with one another, and a transverse element extending between said grip pairs; and a foot located on the lower end of each upright member and arranged to be perpendicular to the upright member, each foot including a surface contacting pad which is fixed to said upright member and a wheel which is hinged to said pad and is flexibly biased to extend linearly from an end of said pad.

7. The walker of claim 6 wherein said wheel is carried on a wheel mount which includes said hinge and which further includes biasing means for biasing said wheel to a linearly extending position, said biasing means including a piece of resilient material which extends about said foot pad and said wheel mount.

8. The walker of claim 6 which includes means for adjusting the height of said grips above said foot.

9. The walker of claim 6 wherein said foot pad has a non-slip surface thereon.

10. A walker comprising:

a frame having a pair of spaced apart upright members, and a crosspiece extending between the upright member;

a handle portion attached to the upright members adjacent the upper end thereof;

a foot located on the lower end of each upright member and arranged to be perpendicular to the upright member, each foot including a surface-contacting pad which is fixed to said upright member and is constructed and arranged to support the walker on a surface, a wheel mount which is flexibly biased to extend linearly from the forward end of said pad, and which includes a hinge which is fixed between the pad and said wheel mount, and which includes tubular biasing means in the form of a piece of resilient material which surrounds said foot pad and said wheel mount for biasing said wheel mount to a linearly extending position.

11. The walker of claim 10 wherein said handled portion includes a pair of opposed, vertically disposed segments, each receivable on an upright member, a grip pair on top of each vertically disposed segment, wherein each of said grip pairs includes two grips located one above the other which are vertically aligned with one another.

12. The walker of claim 10 which includes means for adjusting the height of said hand grips above said foot pads.

13. The walker of claim 10 wherein said resilient material has a non-slip surface thereon to prevent slippage of said foot pad on a supporting surface.

* * * * *